United States Patent [19]

Makihara et al.

[11] Patent Number: 5,041,032

[45] Date of Patent: Aug. 20, 1991

[54] STERN BRACKET FOR SUPPORTING OUTBOARD MOTOR OF BOAT

[76] Inventors: Nobuo Makihara, No. 5-14-1, Morisaki, Yokosuka City; Hideo Tahara, No. 1029015, Akiya, Yokosuka City, both of Japan

[21] Appl. No.: 288,361

[22] Filed: Dec. 22, 1988

[30] Foreign Application Priority Data

Dec. 24, 1987 [JP] Japan ..... 62-196294[U]

[51] Int. Cl.[5] ..... B63B 1/18

[52] U.S. Cl. ..... 440/53; 440/66; 440/900; 248/640

[58] Field of Search ..... 114/343, 362, 364; 440/53, 900, 66, 68, 70; 248/640–643

[56] References Cited

U.S. PATENT DOCUMENTS 4,708,087 11/1987 Potter, Jr. ..... 114/362

4,813,365 3/1989 Lindstrom et al. ..... 114/56

*Primary Examiner*—Ed Swinehart

*Attorney, Agent, or Firm*—Pennie & Edmonds

[57] ABSTRACT

An outboard motor supporting arrangement of a boat includes a stern bracket fixed to a transom of the boat. The stern bracket is U-shaped, and has a flat bottom and left and right side walls extending upwardly from left and right ends of the bottom. Each side wall includes a slant section and a vertial section extending upwardly from an upper end of the slant section. In each side wall, there is further formed a projecting portion projecting outwardly, and extending longitudinally of the boat, for preventing water from be splashed on the outboard motor.

25 Claims, 9 Drawing Sheets

STERN BRACKET FOR SUPPORTING OUTBOARD MOTOR OF BOAT

BACKGROUND OF THE INVENTION

The present invention relates to an outboard motor supporting arrangement designed to prevent water from being splashed on an outboard motor.

A commonly assigned, U.S. patent application Ser. No. 129,561 shows an outboard motor supporting arrangement. In this arrangement, the outboard motor is supported through a stern bracket which is fixed to a rear surface of a boat transom, and which is provided with a deflector for regulating a rearward water flow rearward of the transom to improve the stability of the boat and the propulsion efficiency at high speeds.

In this arrangement, however, the water flow flowing along a boat side bends at the side of the transom and strikes against the deflector, so that the water splashes upwardly and dashes against the outboard motor. Therefore, this arrangement is unsatisfactory for the durability of the outboard motor.

SUMMARY OF THE INVENTION

It is an object of the present invention to provide an outboard motor supporting arrangement which can protect the outboard motor from splashes.

According to the present invention, an outboard motor supporting arrangement comprises a stern bracket adapted to be fixed to a rear surface of a boat transom.

The stern bracket comprises a bottom having left and right ends, and left and right side walls extending upwardly from the left and right ends of the bottom, respectively. Each of the side walls comprises an upper section, and a lower section which comprises a slant subsection extending from the bottom obliquely. Each of the side walls further comprises a first projecting portion projecting outwardly from an upper end of the lower section, and extending substantially in parallel to a fore and aft axis of the boat.

Preferably, the projecting portion of each side wall has a downwardly facing outside surface. In this arrangement, the upwardly splashed water is directed away from the stern bracket, so that the outboard motor is protected against the splashes.

DETAILED DESCRIPTION OF THE INVENTION

Figure 1:
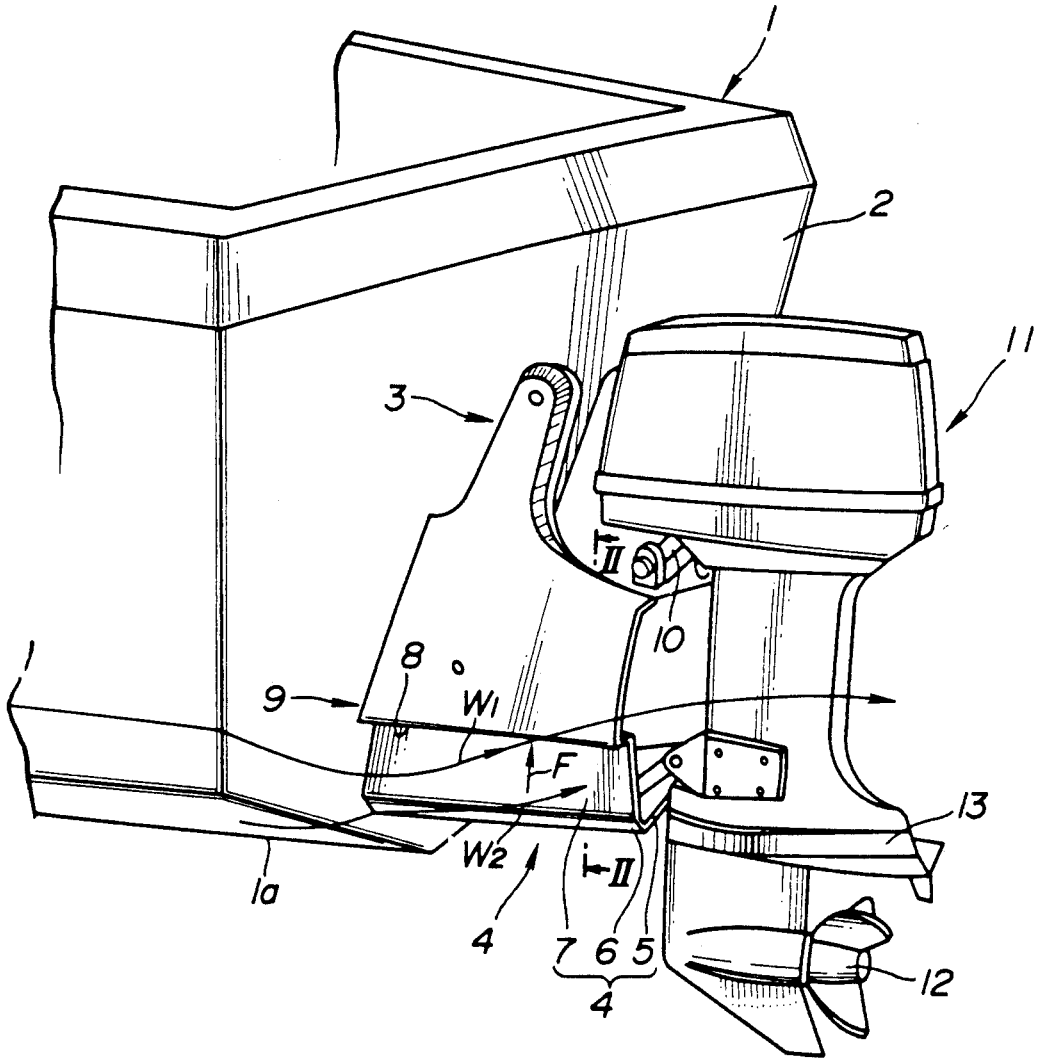
FIG. 1 is a perspective view of an outboard motor supporting arrangement according to a first embodiment of the present invention.
Figure 2:
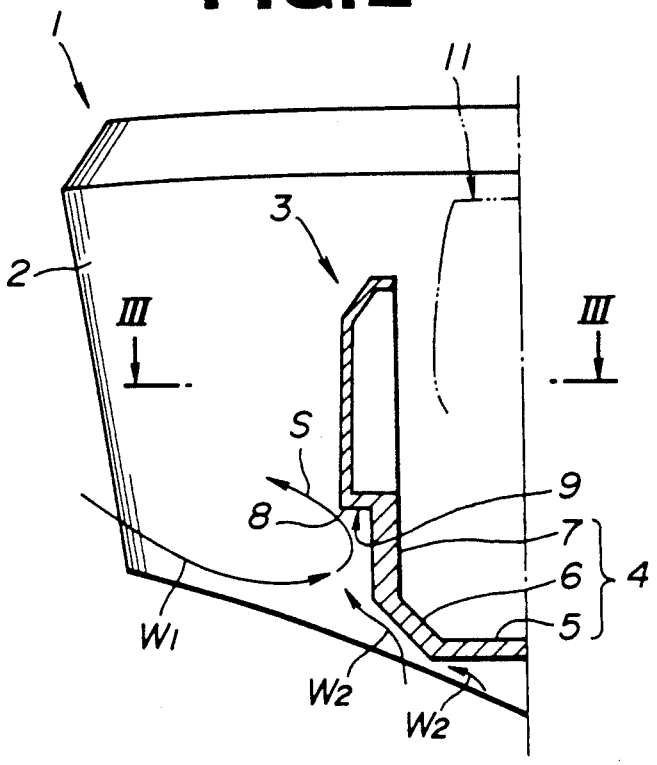
FIG. 2 is a sectional view taken across a line II—II of FIG. 1, of the left-hand half of the arrangement.
Figure 3:
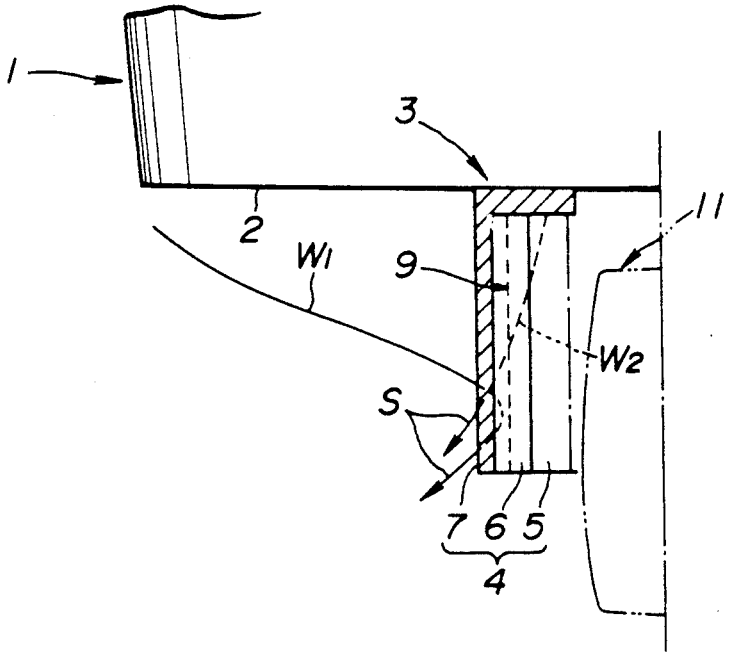
FIG. 3 is a sectional view taken across a line III—III of FIG. 2, showing the left-hand half of the arrangement.

A first embodiment of the present invention is shown in FIGS. 1–3.

A boat has a hull 1 including a transom 2. A stern bracket 3 is fixed to a central portion of a rear surface of the transom 2. The stern bracket 3 includes a deflector plate 4 which is an integral part of the stern bracket 3. The deflector plate 4 is located slightly above a bottom 1*a* of the boat body 1. The shape of the deflector plate 4 has a bilateral symmetry. The deflector plate 4 includes a deflector bottom plate 5, left and right deflector slant plates 6, and left and right deflector side plates 7. The deflector bottom plate 5 is substantially flat and horizontal. That is, the deflector bottom plate 5 is substantially parallel to a longitudinal axis (a fore and aft axis) and a lateral axis of the boat, and substantially perpendicular to a vertical axis of the boat. The deflector bottom plate 5 has a left and right end. The left and right slant plates 6 extend outwardly and upwardly from the left and right ends of the deflector bottom plate, respectively. The left and right side plates 7 extend upwardly from upper ends of the left and right slant plates 6. Thus, the deflector plate 4 is shaped like the letter U by the horizontal bottom plate 5, and left and right side walls extending upwardly from the left and right ends of the bottom plate 5. The left side wall is constituted by the left slant plate 6 and the left side plate 7, and the right side wall is constituted by the right slant plate 6 and the side plate 7. In this embodiment, the bottom, slant and side plates 5, 6 and 7 are all integral parts of the deflector plate 4. The outside surface of each slant plate 6 of this embodiment is substantially flat and inclined.

In this embodiment, a projecting portion 9 is formed in each of the left and right deflector side plates 7. The projecting portion 9 has a downwardly facing outside surface 8 which is substantially horizontal and parallel to the bottom plate 5. Each of the left and right side plates 7 of this embodiment has upper and lower parts which are both substantially vertical and substantially parallel to a vertical plane passing through the longitudinal and vertical axes. The projecting portion 9 of each side wall projects laterally of the hull 1 from an upper end of the lower part of the side plate 7. The downwardly facing surface 8 of the projecting portion 9 of each side wall extends longitudinally of the hull 1. In each side wall, a flat vertical outside surface of the upper part of the side plate 7 extends from an outer end of the downwardly facing surface 8. The projecting portion 9 of each side wall of this embodiment is in the form of a step.

A clamp 10 is mounted on rear upper portions of the side plates 7. An outboard motor 11 is supported on the stern bracket 3 through the clamp 10. A propeller 12 is provided in a lower portion of the outboard motor 11.

A splash plate 13 is formed in the outboard motor 11 above the propeller 12. The outboard motor supporting arrangement is explained more in detail in the above-mentioned U.S. application Ser. No. 129,561. The explanation of this document is herein incorporated by reference.

As shown in FIGS. 2 and 3, the lateral width of an under surface of the bottom plate 5 is approximately equal to or greater than the lateral width of the outboard motor 11.

In this embodiment, each side wall of the stern bracket 3 is divided by the projecting portion 9 into an upper section and a lower section. The lower section of each side wall comprises the slant plate 6 forming a slant subsection. The bottom plate 5 forms a bottom of the stern bracket 3. As shown in FIGS. 1 and 2, the bottom 1*a* of the hull 1 has a rear border at which the bottom 1*a* and the transom 2 meet each other. As shown in FIG. 2, the upper end of the lower section of each side wall is located at the position whose distance from an imaginary center vertical plane shown by a one-dot chain line in FIG. 2 is smaller than the lateral distance between the left or right end of the rear border of the bottom 1*a* of the hull 1, and the upper end of the lower section, as measured along the lateral axis of the boat. Therefore, the lateral distance between the upper ends of the lower sections of the left and right side walls of the stern bracket 3 is smaller than the half of the lateral distance between the left and right ends of the rear border of the bottom 1*a* of the hull 1. As shown in FIG. 2, the projecting portion 9 of each side wall is widely spaced from the lower end of the transom 2, and the left or right end of the transom 2, and the bottom 5 of the stern bracket 3 is spaced from the lower end of the transom 2. As shown in FIG. 1, the rear side of the stern bracket 3 is open from the bottom of the stern bracket 3 to the upper end of the stern bracket.

When the boat is in motion especially at low speeds, the water flows rearwardly along each side of the hull 1, and curves at the left or right edge of the transom 2 toward the stern bracket 3, as shown by an arrow $W_1$. This rearward side flow $W_1$ on each side strikes against the deflector side plate 7, and then rises upwardly along the side plate 7. On the other hand, a rearward central flow shown by an arrow $W_2$ flows rearwardly along the bottom 1*a* of the hull 1, and curves outwardly along each deflector slant plate 6, and rises upwardly along each deflector side plate 7 together with the rearward side flow $W_1$. In the arrangement of this embodiment, however, the water flows $W_1$ and $W_2$ rising along the deflector side plate 7 on each side strike against the downwardly facing surface 8 of the projecting portion 9. Thus, the projecting portion 9 on each side limits the upward movement of the water, and changes the direction of the water flow. After the collision against the downwardly facing surface 8, the water scatters as a splash S upwardly and outwardly away from the stern bracket 3. Thus, the arrangement of this embodiment prevents the splashes S from flying toward the outboard motor 11, and thereby improves the durability of the outboard motor 11. When the rearward side and central flows $W_1$ and $W_2$ strike against the downwardly facing surface 8 of each side wall, an upward force F is applied on the downwardly facing surface 8, as shown in FIG. 1. This upward force F on each side pushes up the rear end of the hull 1, and acts to hold the hull 1 horizontal when the bow is moved up during movement of the boat. Therefore, the arrangement of this embodiment can improve the stability of the moving boat.

Figure 4:
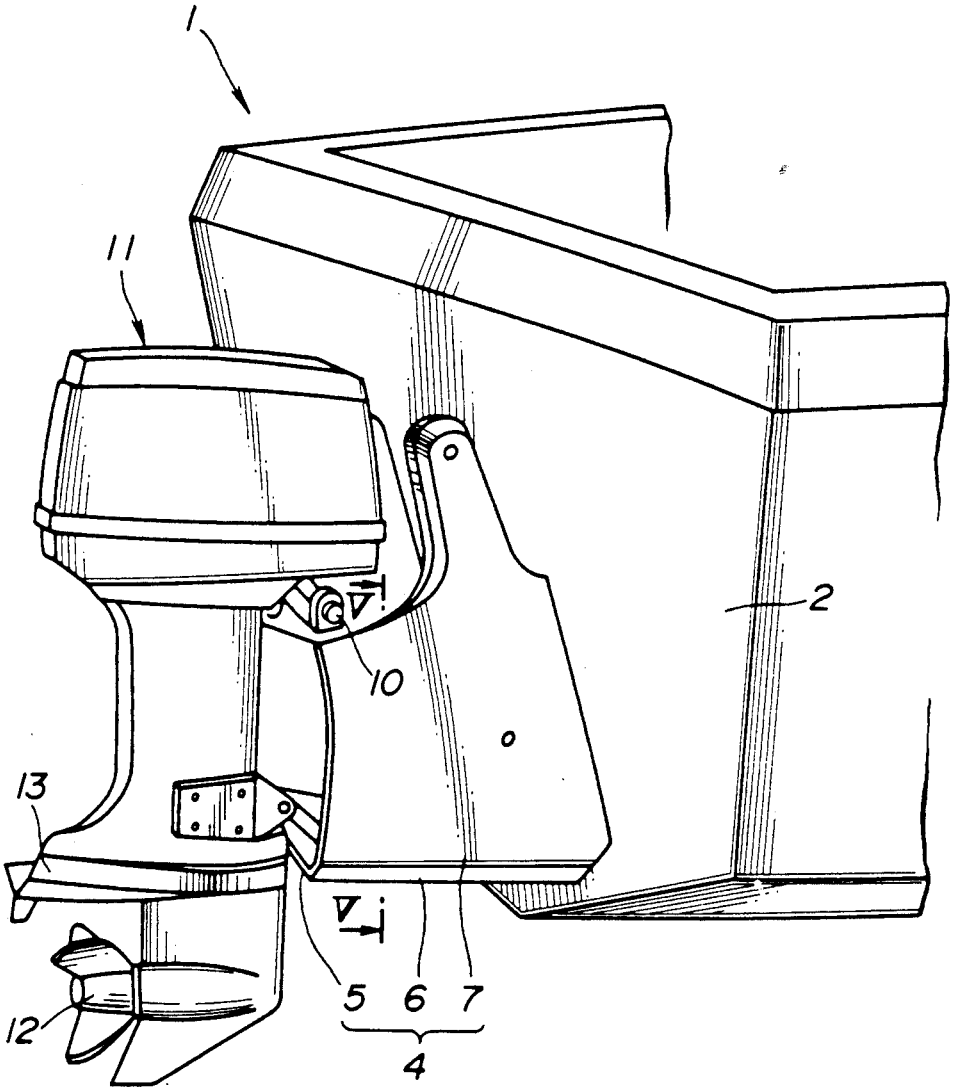
FIG. 4 is a perspective view showing a second embodiment of the invention.
Figure 5:
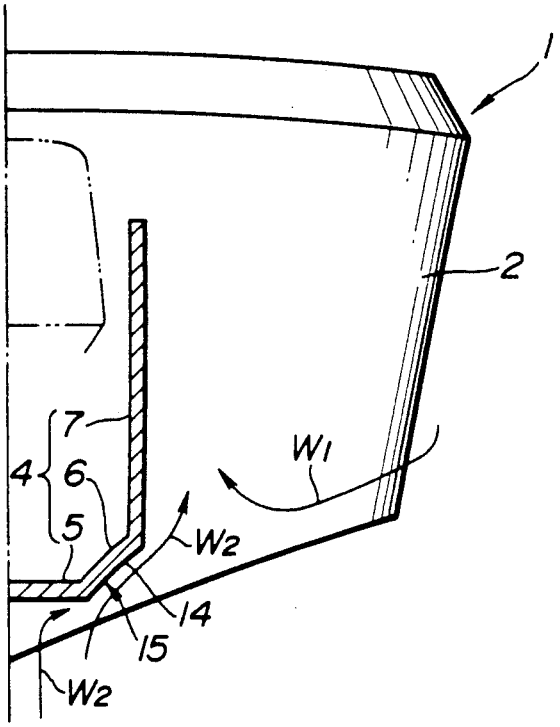
FIG. 5 is a sectional view taken across a line V—V of FIG. 4, of the right-hand half of the arrangement.

A second embodiment of the present invention is shown in FIGS. 4 and 5. In this embodiment, the slant plate 6 of each side wall has a concave outside surface 14. The above-mentioned rearward central flow $W_2$ is guided and directed away from the deflector side plate 7 by the curved outside surface 14 on each side. Therefore, the rearward side wall $W_1$ collides with the rearward central flow $W_2$ outwardly directed by the curved surface 14, and changes the direction. Thus, the arrangement of this embodiment can prevent the rearward side flow $W_1$ on each side from bending inwardly at the edge of the transom 2 toward the stern bracket 3, and thereby prevent the splash S.

Figure 7:
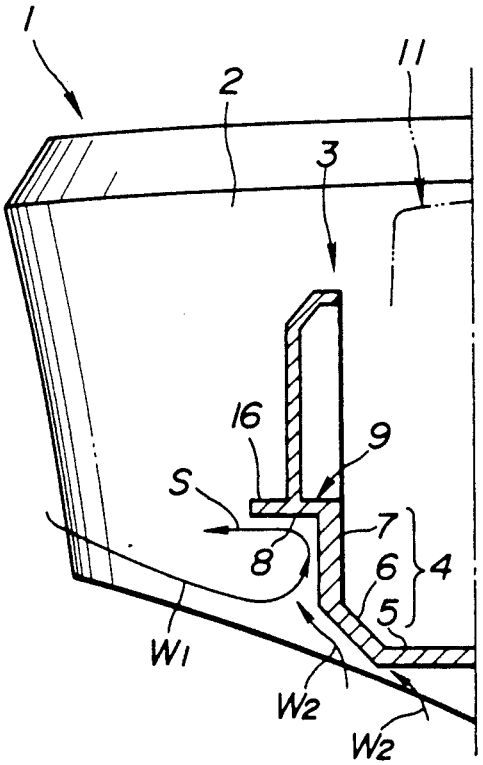
FIG. 7 is a sectional view taken across a line VII—VII of FIG. 6, showing the left-hand half of the arrangement.
Figure 6:
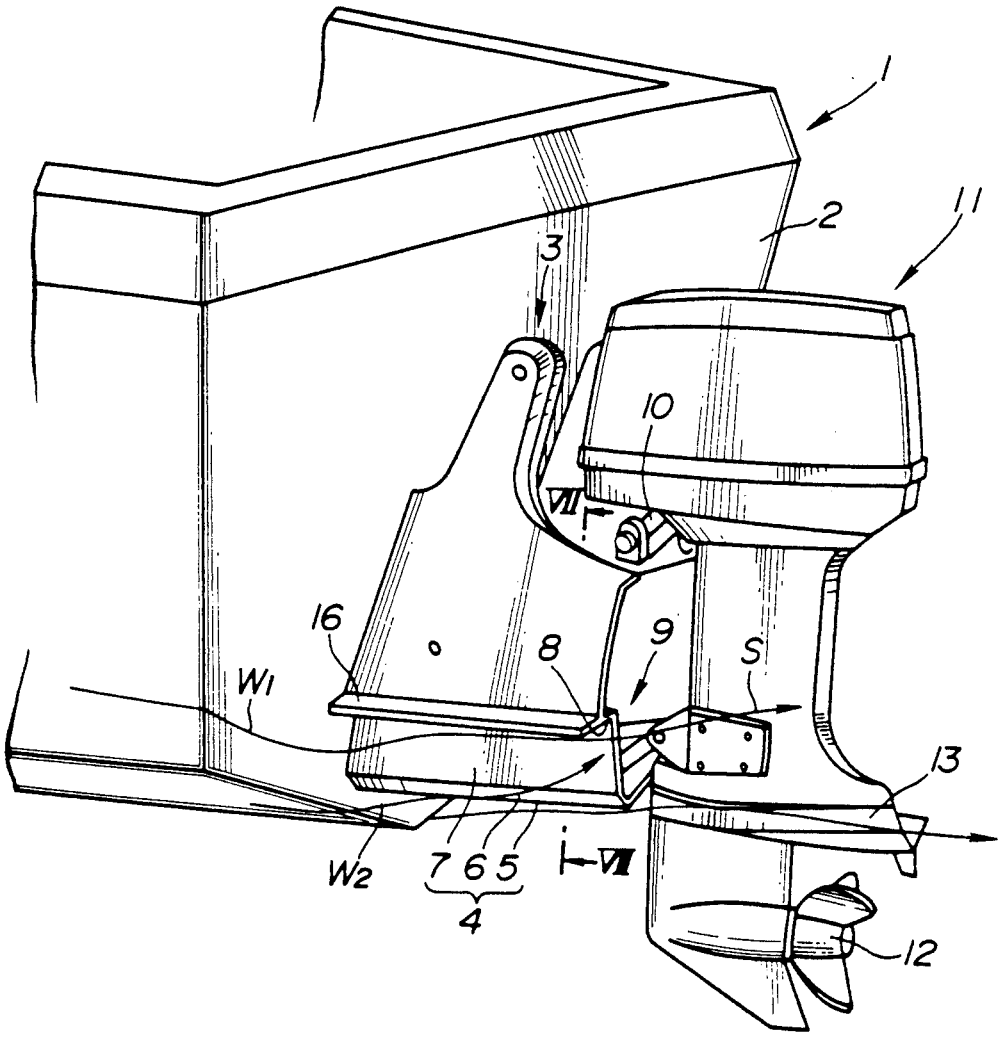
FIG. 6 is a perspective view showing a third embodiment of the invention.

A third embodiment of the present invention is shown in FIGS. 6 and 7. In the third embodiment, the projecting portion on each side consists of a step 9 similar to the step 9 of the first embodiment, and a splash plate 16. A continuous flat downwardly facing surface 8 is formed in the step 9 and the splash plate 16. The surface 8 of this embodiment is also substantially horizontal. The splash plate 16 projects outwardly from the lower end of the upper part of the deflector side plate 7.

In the arrangement of this embodiment, the rearward side and central flows $W_1$ and $W_2$ strike against the wide downwardly facing surface 8 on each side wall, and scatter approximately horizontally away from the stern bracket 3. This arrangement can reliably protect the outboard motor 11 against the splashes S.

Figure 8:
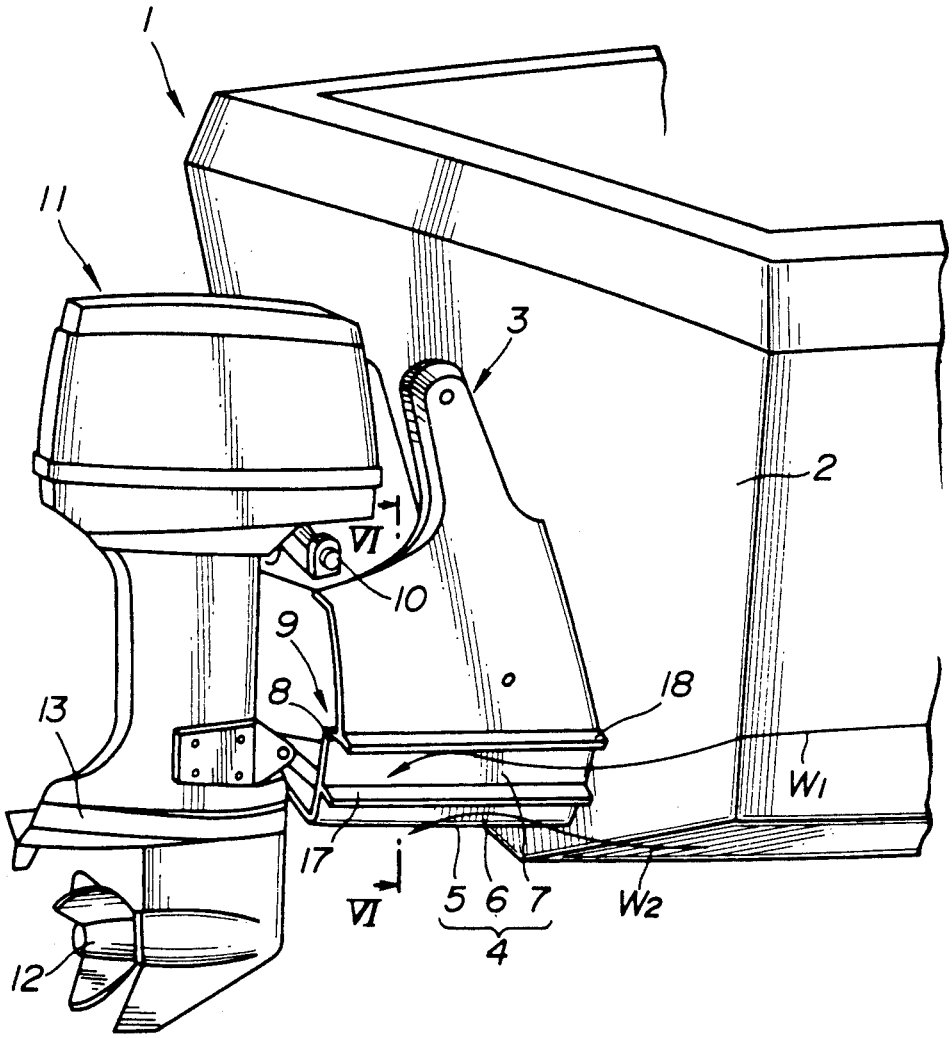
FIG. 8 is a perspective view showing a fourth embodiment of the invention.
Figure 9:
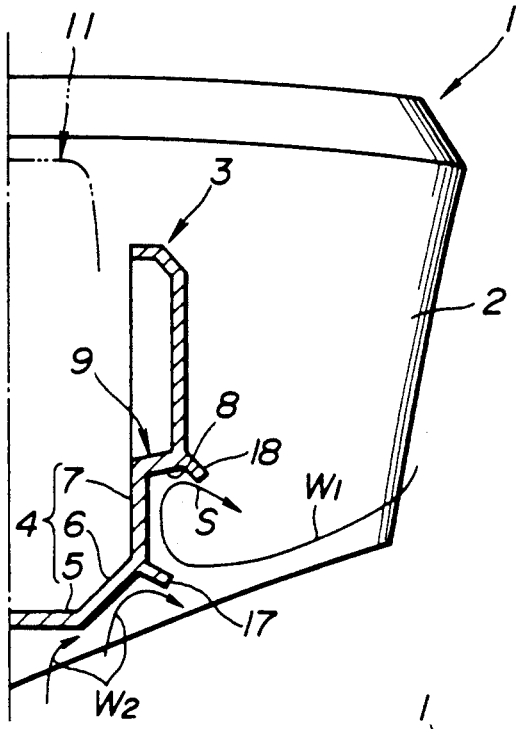
FIG. 9 is a sectional view taken across a line IX—IX of FIG. 8, showing the right hand half of the arrangement.

A fourth embodiment of the present invention is shown in FIGS. 8 and 9. In this embodiment, each side wall has a first inclined splash plate 17 formed on the boundary between the slant plate 6 and the side plate 7, and a second inclined splash plate 18 formed at the outer end of the step 9. Each of the inclined splash plates 17 and 18 slopes down from an inner end to an outer end. The first and second inclined splash plates 17 and 18 on each side project approximately in parallel to each other.

In the fourth embodiment, the splash plate 17 of each side wall forms one projecting portion projecting from the upper end of the slant subsection formed by the slant plate 6. The step 9 and the splash plate 18 form another projecting portion having a downwardly facing outside surface 8 and an upwardly facing outside surface. The downwardly facing outside surface 8 extends laterally from the inner end of the step 9 to the outer end of the splash plate 18. The upwardly facing outside surface extends from the inner end of the splash plate 18 to the outer end of the splash plate 18. Therefore, the inner end of the downwardly facing outside surface is remoter from the outer end of the projecting portion than the inner end of the upwardly facing surface.

In the arrangement of the fourth embodiment, the central flow $W_2$ strikes against the first splash plate 17, and the side flow $W_1$ on each side strikes against the step 9 and the second splash plate 18. Therefore, the water scatters downwardly. Thus, this arrangement can protect not only the outboard motor 11 but also adjacent boats from the splashes S.

Figure 10:
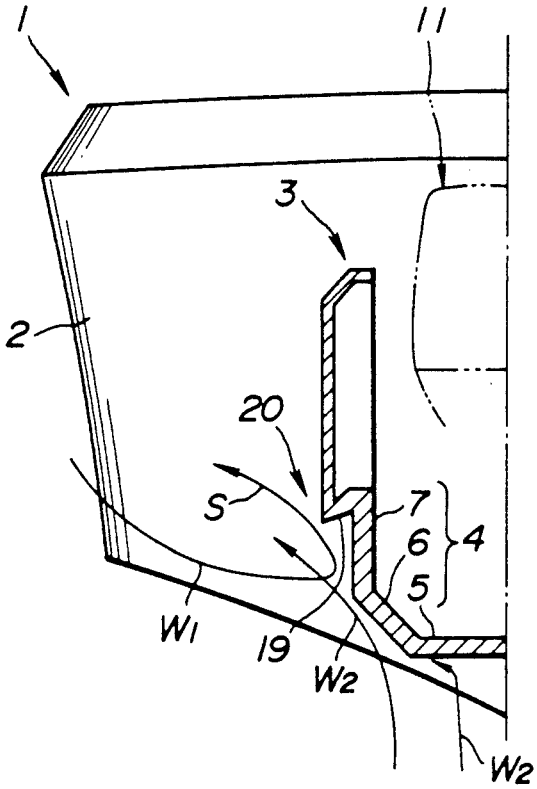
FIG. 10 is a sectional view similar to FIG. 2, but showing a fifth embodiment of the invention.

A fifth embodiment of the present invention is shown in FIG. 10. In this embodiment, there is no splash plate, and the projecting portion of each side wall consists of a step 20 having an inclined downwardly facing surface 19. The inclined downwardly facing surface 19 projects outwardly from the upper end of the lower part of the side plate 7 to an outer end of the step 20, and slopes down from the upper end of the lower part of the side plate 7 to the outer end of the step 20. The inclined downwardly facing surface 19 prevents the splashes S from flying far away.

Figure 11:
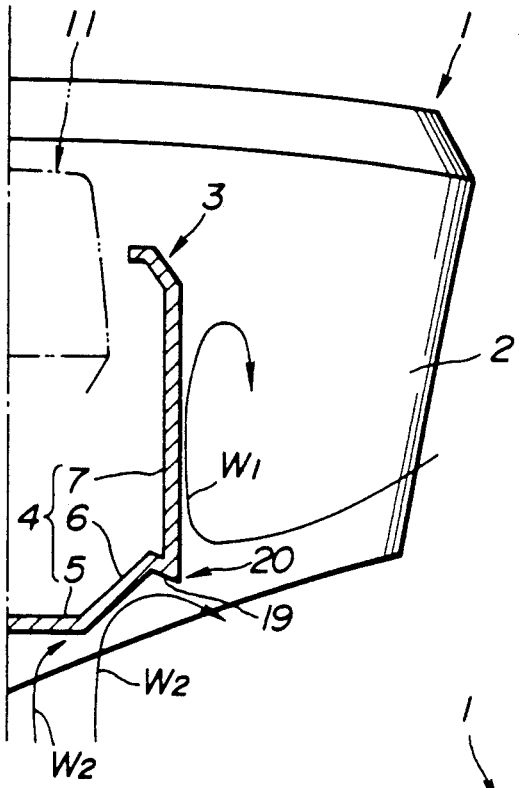
FIG. 11 is a sectional view similar to FIG. 5, but showing a sixth embodiment of the invention.

A sixth embodiment of the present invention is shown in FIG. 11. In this embodiment, a step 20 is formed along the boundary between the slant plate 6 and the side plate 7, and the step 20 has an inclined downwardly facing surface 19 sloping down from an inner end to an outer end. In this arrangement, the central flow $W_2$ strikes against the inclined downwardly facing surface 19 of each side wall, and scatters outwardly and downwardly. The side flow $W_1$ on each side rises along the deflector side plate 7 having no projecting portion, until it loses its energy and falls spontaneously. Therefore, this arrangement can prevent the central and side flows from flying toward the outboard motor 11.

Figure 12:
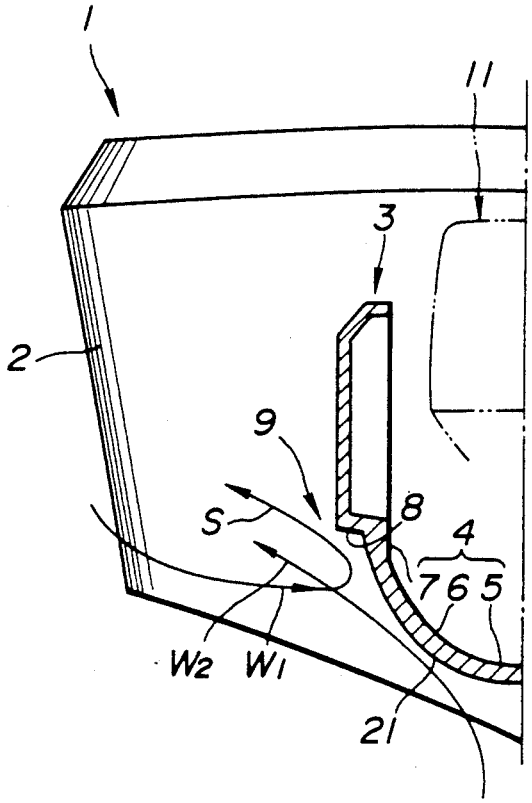
FIG. 12 is a sectional view similar to FIG. 2, but showing a seventh embodiment of the invention.

A seventh embodiment of the present invention is shown in FIG. 12. In this embodiment, the slant plate 6 of each side wall is formed with a convex outside surface 21. The curved outside surface 21 of each slant plate 6 of this embodiment is substantially a cylindrical surface. In each deflector side plate 7, there is formed the projecting portion 9 in the form of a step having the downwardly facing surface 8 which is substantially flat and horizontal.

In the arrangement of the seventh embodiment, the rearward central flow $W_2$ turns outwardly along the convex surface 21 of each side wall without being splashed. Therefore, the splash S produced by the side flow $W_1$ striking against the downwardly facing surface 8 is caught and merged in the central flow $W_2$, and the outboard motor 11 is protected from the splash S.

Figure 13:
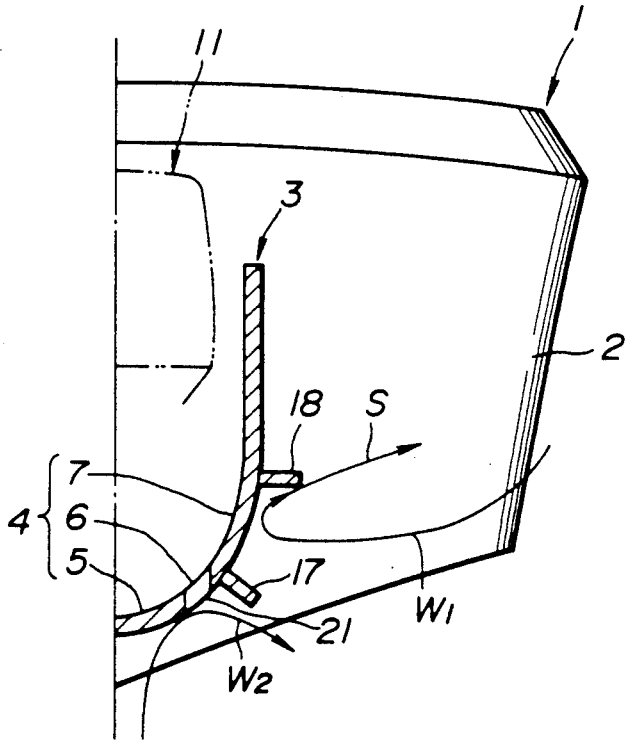
FIG. 13 is a sectional view similar to FIG. 5, but showing an eighth embodiment of the invention.

An eighth embodiment of the invention is shown in FIG. 13. In this embodiment, the slant plate 6 of each side wall has the convex outside surface 21 as in the seventh embodiment, but there are formed the first and second splash plates 17 and 18 in each side wall instead of the step. The first splash plate 17 of each side wall projects from the cylindrical outside surface 21 substantially at right angles. The second splash plate 18 of each side wall projects from the substantially vertical flat outside surface of the side plate 7 substantially at right angles.

In this arrangement, the splash S formed by the central flow $W_2$ striking against the first splash plate 17, and the splash S formed by the side flow $W_1$ striking against the second splash plate 18 are guided individually, so that the outboard motor 11 is reliably protected from the splashes.

What is claimed is:

1. A stern bracket adapted to be fixed to a transom of a boat for supporting an outboard motor, comprising:

a bottom having left and right side portions, and left and right side walls extending upwardly from said left and right side portions of said bottom, respectively, each of said side walls comprising an upper section and a lower section which comprises a slant subsection extending from said bottom obliquely, and a vertical subsection extending upwardly from an upper end of said slant subsection to an upper end of said lower section, each of said upper section and said vertical subsection of said lower section of each side wall having an outside surface which is substantially parallel to a vertical axis and a fore and aft axis of said boat, each of said side walls further comprising a first projecting portion projecting outwardly from said upper end of said lower section, and extending substantially in parallel to said fore and aft axis of said boat and being situated between an upper end and a lower end of said transom.

2. A stern bracket according to claim 1 wherein said projecting portion of each of said side walls has a downwardly facing outside surface extending substantially in parallel to said fore and aft axis.

3. A stern bracket according to claim 2 wherein said downwardly facing surface and an outside surface of said lower portion of each of said side walls diverge from said upper end of said lower section at an angle which is approximately equal to or smaller than 90 degrees.

4. A stern bracket according to claim 2 wherein said downwardly facing surface of said projecting portion has an inner end and an outer end which is spaced from said inner end laterally of said boat, and said outer end being positioned at a level which is equal to or below said inner end.

5. A stern bracket according to claim 4 wherein said upper section of each of said side walls has an outside surface extending upwardly from said outer end of said downwardly facing surface of said projecting portion.

6. A stern bracket adapted to be fixed to a transom of a boat for supporting an outboard motor, comprising:

a bottom having left and right side portions, and left and right side walls extending upwardly from said left and right side portions of said bottom, respectively, each of said side walls comprising an upper section and a lower section which comprises a slant subsection extending from said bottom obliquely, each of said side walls further comprising a first projecting portion projecting outwardly from an upper end of said lower section and extending substantially in parallel to a fore and aft axis of said boat, said projecting portion of each of said side walls having a downwardly facing outside surface and an upwardly facing outside surface extending substantially in parallel to said fore and aft axis, said projecting portion of each of said side walls being situated above a bottom of a hull of said boat.

7. A stern bracket according to claim 6 wherein said lower section comprises a vertical subsection extending from an upper end of said slant subsection to said upper end of said lower section, each of said upper section and said vertical subsection of said lower section of each of said side walls having an outside surface which is substantially flat and parallel to a vertical axis and said fore and aft axis of said boat.

8. A stern bracket according to claim 6 wherein said upwardly facing surface and downwardly facing surface of said projecting portion of each of said side walls extend inwardly from an outer end of said projecting portion to respective inner ends, said inner end of said downwardly facing surface of each of said side walls being remoter from said outer end of said projecting portion than said inner end of said upwardly facing surface.

9. A stern bracket according to claim 6 wherein each of said side walls further comprises a second projecting portion projecting from an upper end of said slant subsection.

10. A stern bracket according to claim 6 wherein each of said side walls further comprises a second projecting portion projecting outwardly.

11. A stern bracket according to claim 6 wherein said slant subsection of each of said side walls has an outside surface which is substantially flat.

12. A stern bracket according to claim 6 wherein said slant subsection of each of said side walls has an outside surface which is convex.

13. A stern bracket according to claim 6 wherein said bottom is substantially flat.

14. A boat having a hull which includes a transom having upper and lower ends and left and right ends, and a stern bracket fixed to said transom for supporting an outboard motor, said stern bracket comprising:

a bottom having left and right side portions, and left and right side walls extending upwardly from said left and right side portions of said bottom, respectively, each of said side walls comprising an upper section and a lower section which comprises a slant subsection extending from said bottom obliquely, each of said side walls further comprising a first projecting portion projecting outwardly from an upper end of said lower section and extending substantially in parallel to a fore and aft axis of said boat, said projecting portion of each side wall being spaced from said lower end of said transom said projection portion being situated between said upper end and lower ends of said transom.

15. A boat according to claim 14 wherein said bottom of said stern bracket being situated between said upper end and lower ends of said transom.

16. A boat according to claim 14 wherein said projecting portions of said left and right side walls of said stern bracket are spaced from said left and right ends of said transom.

17. A boat according to claim 14 wherein said projecting portions of said side wall have a downwardly facing outside surface extending substantially in parallel to said fore and aft axis.

18. A boat according to claim 17 wherein said hull further comprises a bottom having a rear border which has left and right ends, and a lateral distance between said upper ends of said lower sections of said left and right side walls is smaller than a half of a lateral distance between said left and right ends of said rear border of said bottom of said hull.

19. A boat according to claim 17 wherein said stern bracket is approximately U-shaped, and has a rear side which is open from said bottom to an upper end of said stern bracket.

20. A boat according to claim 17 wherein said downwardly facing surface of each side wall has an inner end and an outer end which is spaced from said inner end laterally of said boat, and said upper section of each side wall has an outside surface extending upwardly from said outer end of said downwardly facing surface of said projecting portion.

21. A boat according to claim 17 wherein said projecting portion of each side wall further has an upwardly facing outside surface projecting from a lower end of said upper section.

22. A boat according to claim 17 wherein, on each of said left and right sides of said stern bracket, said slant portion of said side wall and said side portion of said bottom of said stern bracket from a continuous smooth outside surface which is curved convexly.

23. A boat according to claim 17 wherein said downwardly facing outside surface and an outside surface of said lower section of each side wall diverge from said upper end of said lower section at an angle which is approximately equal to or smaller than 90 degrees.

24. A boat according to claim 17 wherein said downwardly facing surface of each side wall has an inner end and an outer end which is spaced from said inner end laterally of said boat, and said outer end being positioned at a level which is equal to or below said inner end.

25. A boat according to claim 17 wherein each of said side walls further comprises a second projecting portion projecting outwardly and having a downwardly facing outside surface which is approximately parallel to said downwardly facing outside surface of said first projecting portion.

* * * * *